United States Patent [19]

Wirz

[11] 3,986,713

[45] Oct. 19, 1976

[54] SHEET FEEDING APPARATUS HAVING TRAVELING FEED GRIPPERS

[75] Inventor: Arno Wirz, Bammental, Germany

[73] Assignee: Heidelberger Druckmaschinen Aktiengesellschaft, Heidelberg, Germany

[22] Filed: Dec. 16, 1974

[21] Appl. No.: 533,270

[30] Foreign Application Priority Data

Dec. 14, 1973 Germany ..... 2362104

[52] U.S. Cl. ..... 271/268; 271/14

[51] Int. Cl.[2] ..... B65H 5/10

[58] Field of Search ..... 271/14, 139, 140, 267, 271/268, 269; 74/56

[56] References Cited

UNITED STATES PATENTS

| | | | |
|---|---|---|---|
| 1,203,914 | 11/1916 | Schafer | 271/267 |
| 1,298,485 | 3/1919 | Feldman | 271/14 |
| 1,893,455 | 1/1933 | Stone | 271/140 |
| 2,922,646 | 1/1960 | Buttner | 271/268 |

*Primary Examiner*—Robert W. Saifer
*Attorney, Agent, or Firm*—Herbert L. Lerner

[57] ABSTRACT

In sheet feeding apparatus of the type having a feed table, feed grippers movable back and forth to transfer sheets on the feed table, carrier means including an oscillating lever, a shaft, a crankwheel mounted on the shaft and a coupler connected between the crankwheel and the lever, the carrier means being movable above the feed table between a first and a second position for mounting the feed grippers thereon, drive means and operable means for respectively moving and lowering the carrier means so as to dispose the feed grippers below the top surface of the feed table as the carrier means commences a return movement to the first position, the improvement including an eccentric crankpin mounted on the crankwheel and connected to the coupler at a location thereof spaced from the location at which the coupler is connected to the oscillating lever; and motion generating means including the crankwheel actuated by the driving means for imparting a cycloid motion to said eccentric crankpin about the center of rotation of the crankwheel.

5 Claims, 7 Drawing Figures

SHEET FEEDING APPARATUS HAVING TRAVELING FEED GRIPPERS

The invention of the instant application relates to a sheet feeding apparatus having traveling feed grippers and is provided with a carrier moved back and forth by a drive mechanism disposed underneath a feed table plate. The traveling feed grippers which transfer the sheets protrude through slots in the feed table plate during the transfer operation but are lowered below the sheet guiding surface of the feed table plate for most of their return travel to an initial sheet transfer position. The carrier of the traveling feed grippers is an oscillating lever pivoted to a crank wheel via a coupler. The oscillating lever has a fulcrum bearing adjustable over the length of the lowering stroke of the traveling feed grippers by a control device in synchronsim with the operating cycle of the apparatus.

A sheet feeding apparatus of the foregoing type is disclosed in U.S. Pat. No. 3,877,694, issued to the applicant of the instant application on Apr. 15, 1975 and assigned to the same assignee as that of the instant application. It is of relatively simple construction when compared to other machines of the same type, and has very few transmission members. In this heretofore known apparatus, the wear of the limited number of moving parts is readily controllable. As a result of this construction, the speed of the traveling feed grippers is furthermore reduced to a value of zero or close to zero at motion reversal points where the sheet is gripped or set down against front stops. In order to obtain an exact sheet transfer or sheet deposition for rapidly running machines it is, however, of utmost importance that the traveling feed gripers be strongly decelerated prior to a respective sheet transfer or sheet deposition so that the approximate stand-still phase is adequately prolonged.

It is accordingly an object of this invention to develop a drive for a sheet feeding apparatus with traveling feed grippers which strongly decelerates the latter prior to their reversal points resulting in a longer sheet transfer time and thus ensuring a better transfer of a sheet from the suction bars to the traveling feed grippers and a particularly soft deposition thereof on the front stops.

According to the present invention the aforesaid object is achieved by motion means imparting a cycloid motion to an eccentric crankpin attached to a crankwheel actuated by driving means about the center of rotation of that crankwheel; the motion means includes a bearing sleeve having a rim coaxially attached to a shaft, a sun gear connected to that rim and a planetary pinion attached coaxially to the eccentric shaft disposed on that crankwheel, the sun gear facing a lateral wall of the apparatus ahead of the crankwheel.

This arrangement ensures that even during a greater output of the machine, i.e. during a further increase of its output, a sheet is strongly decelerated prior to the reversal points of the traveling feed grippers, thus resulting in a troublefree acceptance of a sheet by the suction bars and a soft deposition thereof on the front stops.

The apparatus according to the invention is further characterized by running particularly quietly as a result of a reliable kinematic solution to the problem, the drive being realized by simple gearing elements eliminating any impulse loads possibly arising due to the use of cams. A simple and reliable manufacture and assembly of a sheet feeding apparatus is possible due to its economic construction, the apparatus being rugged and of considerable longevity.

Other features which are considered as characteristic for the invention are set forth in the appended claims.

Although the invention is illustrated and described herein as embodied in a sheet feeding apparatus having traveling feed grippers, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which.

Figure 4:
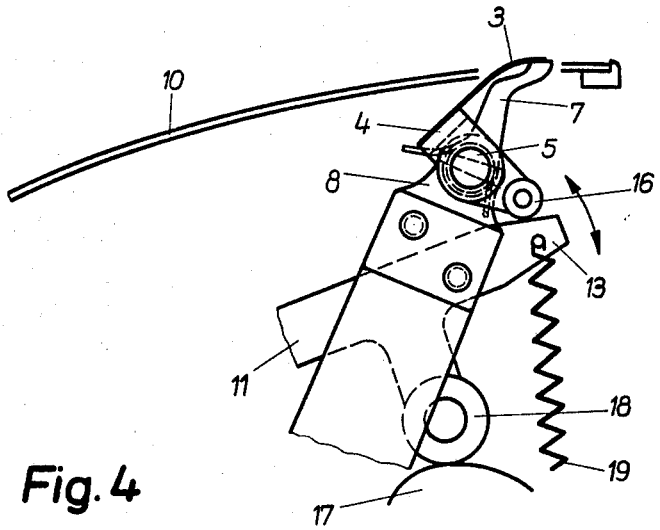
FIG. 4 is a side elevational view showing the traveling feed grippers after a sheet has been seized thereby.
Figure 5:
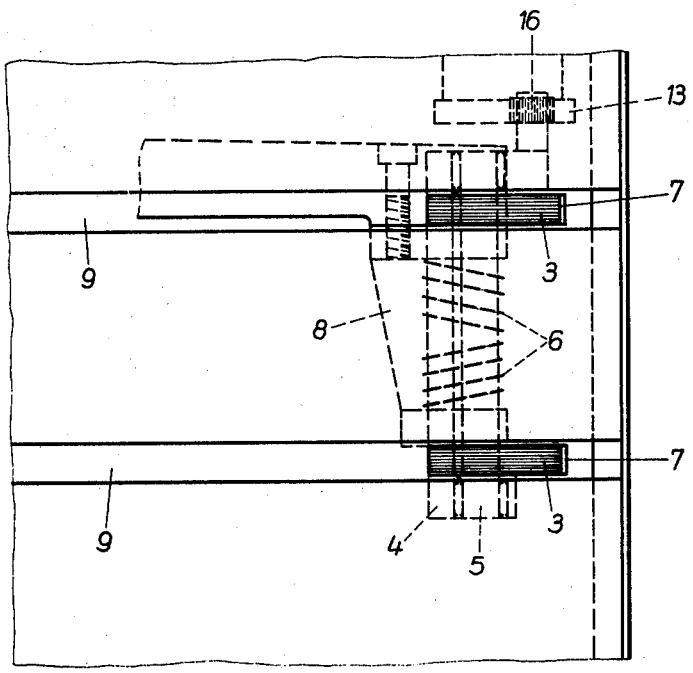
FIG. 5 is a top view of the traveling feed grippers.

Referring now to the drawings, there is shown therein a sheet feeding apparatus according to the invention which includes a suction bar 1 that lifts the top sheet off a supply stack 2 and passes it on to two traveling feed grippers 3, the latter being mounted on a gripper bridge 4 which is best shown in FIGS. 4 and 5. The gripper bridge 4 is pivoted on a shaft 5 which is biased by torsion springs 6. During rotation of the gripper bridge 4, each of the two traveling feed grippers 3 are lifted off a gripper rest 7 which is mounted in fixed position on the shaft 5, the latter in turn being secured in a gripper bridge bearing 8 by pinning.

Figure 1:
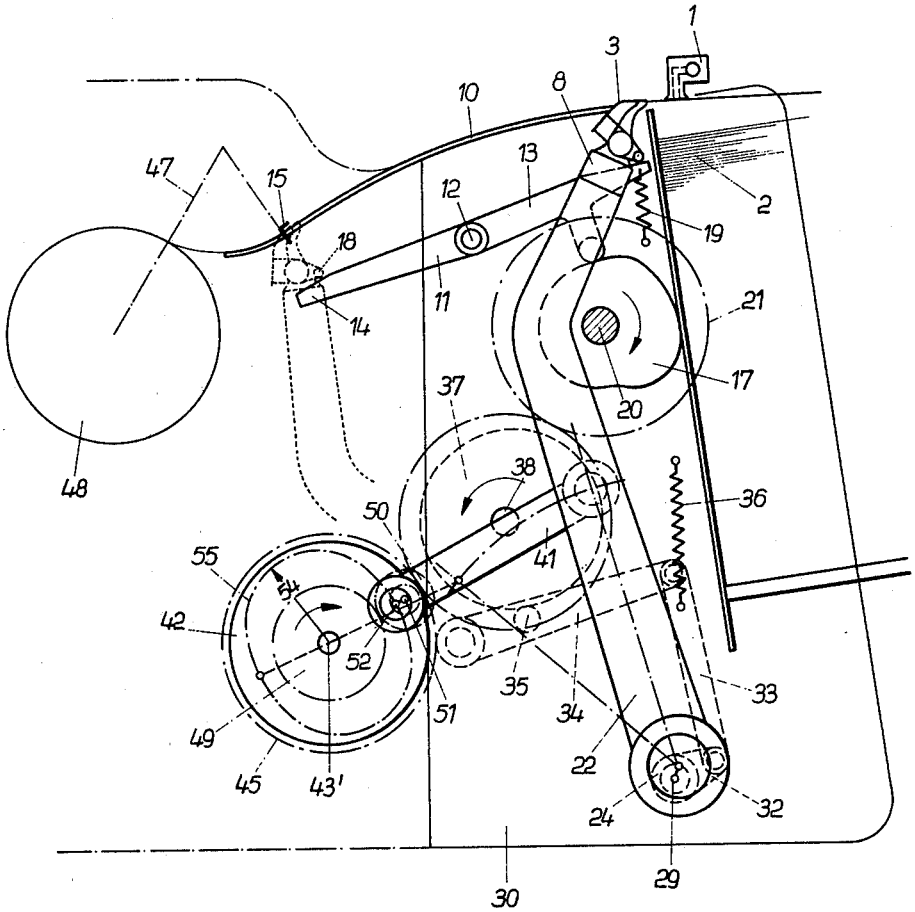
FIG. 1 is a side elevational view of one embodiment of a sheet feeding apparatus according to the invention with the traveling feed grippers being shown in sheet transfer position.

The traveling feed grippers 3 and the gripper rests 7 protrude upwardly through slots 9 formed in a curved feed table plate 10. Control of the opening and closing movements of the traveling feed grippers 3 is effected by a lever 11 which is disposed underneath the feed table plate 10 and pivoted for movement in a vertical plane about a bearing 12. An upper arm 13 of the lever 11 controls the opening and closing movements of the traveling feed gripper 3 in the sheet transfer position as seen in FIG. 1. A lower arm 14 of the lever 11 releases the grip of feed grippers 3 when a sheet is placed against front stops 15. A roller 16, which is mounted on the gripper bridge 4, cooperates with the lever 11 for the purpose of opening and closing the traveling feed grippers 3.

The lever 11 is pivoted about the bearing 12 by a cam 17 through the intermediary of a cam follower 18 mounted on the arm 13 which is urged and maintained against a cam 17 by a tension spring 19. The cam 17 is secured to a single-revolution shaft 20 having a drive gear 21 mounted thereon.

Figure 3:
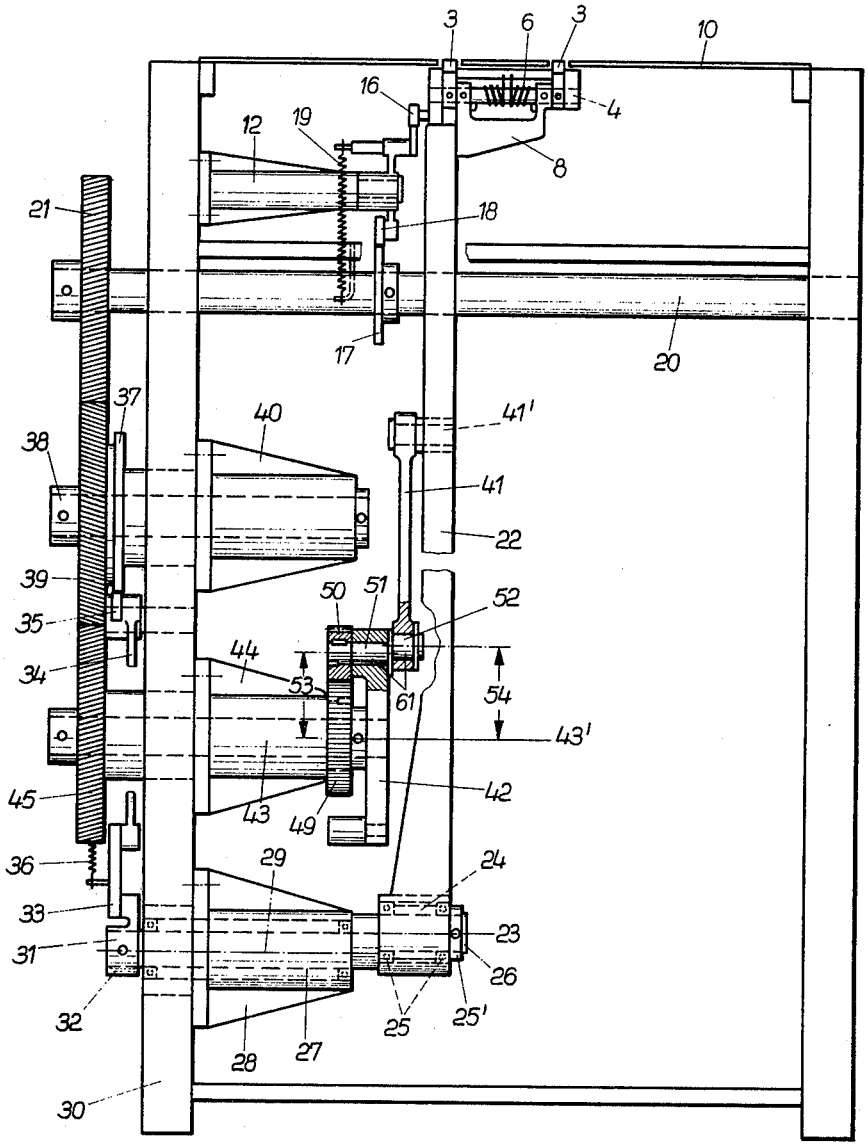
FIG. 3 is a front view of the sheet feeding apparatus shown in FIGS. 1 and 2 with the traveling feed grippers in sheet transfer position.

The aforedescribed gripper bridge bearing 8 is secured to the free end of an oscillating lever 22 which oscillates about an axis of rotation 23 of a fulcrum bearing 24. The axis 23 extends horizontally and traversely to the direction of feed of the sheets. The construction details of the fulcrum bearing 24 can best be seen in FIG. 3. It is provided with ball bearings 25 which are secured laterally by a ring 25. The fulcrum bearing 24 is disposed on a free, offset end 26 of an eccentric shaft 27 which is supported in a bearing sleeve 28 for rotation about an axis 29.

The bearing sleeve 28 is secured in a lateral wall 30 of the sheet-feeding apparatus. The eccentric shaft 27 protrudes from the bearing sleeve 28 through an opening in the lateral wall 30, and the protruding section forms a bearing pin 31 for a positioning lever 32 mounted thereon. The positioning lever 32 is displaceably secured to a cam lever 34 by means of a link 33. The cam lever 34 has a roller 35 mounted thereon which is urged against a cam 37 by a tension spring 36 acting on the link 33.

A shaft 38 carries the cam 37 as well as a spur gear wheel 39 which meshes with the aforementioned drive gear 21. The shaft 38 rotates in a bearing sleeve 40 (FIG. 3) which is securely fixed against the inside of the lateral wall 30.

A coupler or connecting rod 41 is secured to the oscillating lever 22 about halfway along the length of the latter. A crankwheel 42 is mounted on a shaft 43; an eccentric crank 61, spaced at a driving distance 53 from the rotary axis 43' of the shaft 43, is pivoted on the crankwheel 42. An eccentric crank pin 52 of the eccentric crank 61 is connected to a coupler or connecting rod 41 at a varying radius 54 of a cycloid track 55 from the axis of rotation 43', and drives the oscillating lever 22 therewith. A planetary pinion 50 disposed on the eccentric crank 61 forward of the crank wheel 42 is firmly secured thereto. A sun wheel or gear 49 is attached to the rim of a bearing sleeve 44 in front of the crank wheel 42.

The shaft 43 is pivoted in a bearing sleeve 44 secured to the lateral wall 30 of the apparatus. A spur gear wheel 45 is mounted on the free end of the shaft 43 projecting through the sidewall 30 and meshes with a spur gear wheel 39. Hence all drive and control members are attached to the lateral wall 30; the single-revolution shaft 20 of the drive gear 21 passing transversely through the sheet feeding apparatus is, however, additionaly supported in a second lateral wall 46.

A sheet set by the oscillating lever 22 against the front stops 15 is gripped upon alignment thereof by an auxiliary gripper 47 and fed to a printing cylinder 48. All oscillating parts, for example the oscillating lever 22, the connecting rod 41, the gripper bridge bearing 8 and the gripper bridge 4, are preferably fabricated of magnesium or aluminum alloy.

Figure 6:
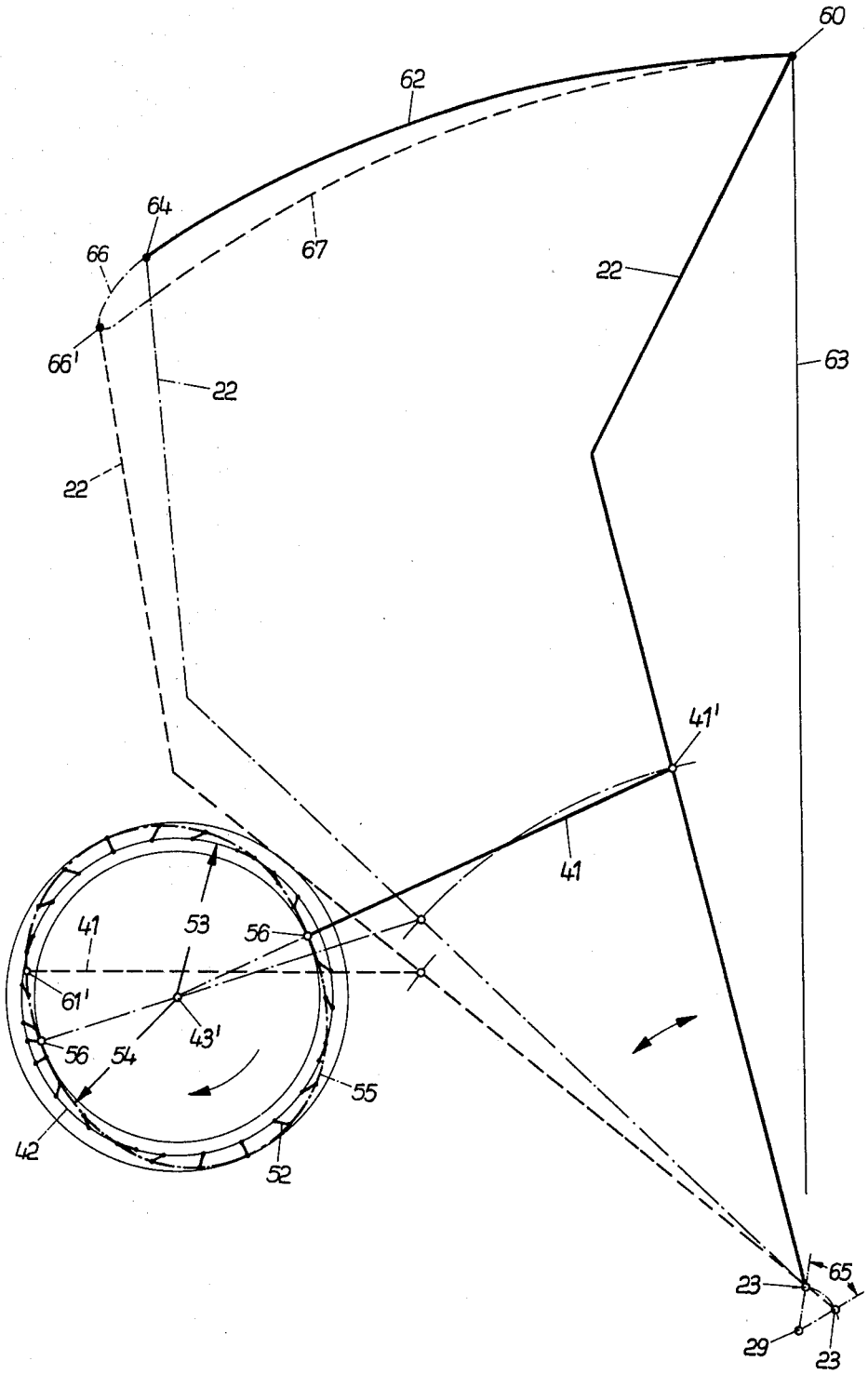
FIG. 6 is a schematic diagram of the function of the sheet feeding apparatus shown in FIGS. 1 to 5.

The operation of the aforedescribed apparatus of the invention will now be set forth with reference to FIG. 6. When the suction bar 1 transfers a sheet from the stack 2 to the feed grippers 3, the oscillating lever 22 is disposed in a sheet transfer position 60 shown by solid lines in FIG. 6. The connecting rod 41 then also occupies the position shown in solid lines in FIG. 6. The eccentric crank pin 52 of the eccentric crank 61 faces the axis of rotation 43' at this time and also lies on the connecting line between the axis of rotation 43' and the fulcrum 41' of the connecting rod 41 on the oscillating lever 22.

Figure 2:
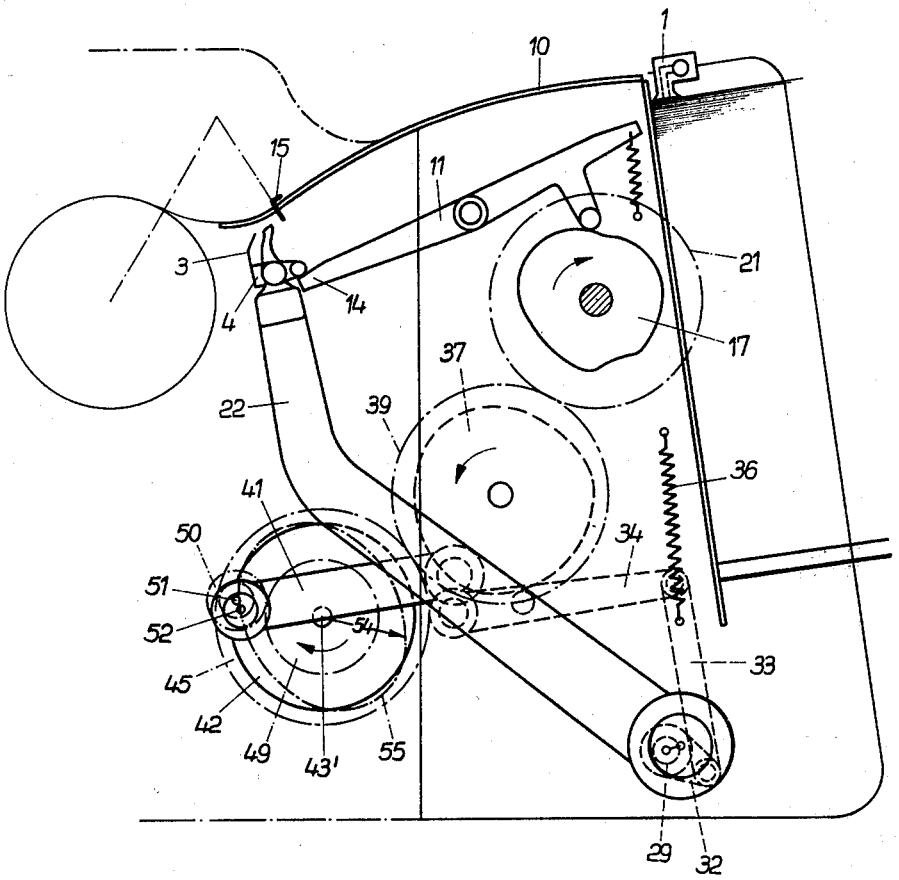
FIG. 2 is a side elevational view of the sheet feeding apparatus shown in FIG. 1, but with the traveling feed grippers shown in a lowered position.

As best seen in FIGS. 1 and 2, the planetary pinion 50 rolls off clockwise from the sun wheel or gear 49. The fulcrum 56 of the connecting rod 41 disposed on the eccentric crank 61 then describes a cycloid track 55 characterized by having radii of curvature at extreme positions of the connecting rod 41 which are particularly large. The transmission ratio of the planetary gearing 49 and 50 has been selected so that one half of a revolution of the machine (180°), corresponding to a back-and-forth motion of the oscillating lever 22, also causes a rotation of the eccentric crank pin 52 through 180°.

During the rotation of the fulcrum 56 of the connecting rod 41 around the eccentric crank 61 from the sheet transfer position 60 to the sheet deposition position 64, the traveling feed grippers 3 describe an arc-shaped path 62 having a radius 63, the curvature of the feed table 10 being matched thereto.

The traveling feed grippers 3 reach the front stops 15 in the sheet deposition position 64 and thus free a transported sheet; the oscillating lever 22 then occupies the dot-dash or phantom line position shown as does the connecting rod 41.

Immediately upon the deposition of a sheet on the front stops 15 and the grip release of the traveling feed grippers 3, the cam lever drive 32 to 37 becomes operative and rotates the eccentric shaft 27 about its axis 29. When this occurs, the axis of rotation 23 of the fulcrum bearing 24 is displaced and turned through an angle 65. As a result, the traveling feed grippers 3 are moved along two components of motion, one component being in the direction towards the printing cylinder 48, the other component being in the direction below the feed table 10. The resultant movement is a depression of the traveling feed grippers 3 at an inclination towards the printing cylinder 48 just below the feed table 10 as represented by a dot-dash line 66.

At the termination 66' of this lowering movement, the oscillating lever 22 and the coupler or connecting rod 41 assume respective positions shown by dashed lines. The eccentric crankpin 52 of the eccentric crank 61 then occupies a position 61'.

During the resulting return movement of the oscillating lever 22, the traveling grippers 3 are guided along a broken line 67 below the feed table 10. During the terminal phase of the return movement the traveling feed grippers 3 again project through the slots 9 of the feed table 10 and, upon reaching the sheet transfer position 10, a new sheet transport phase can commence.

Figure 7:
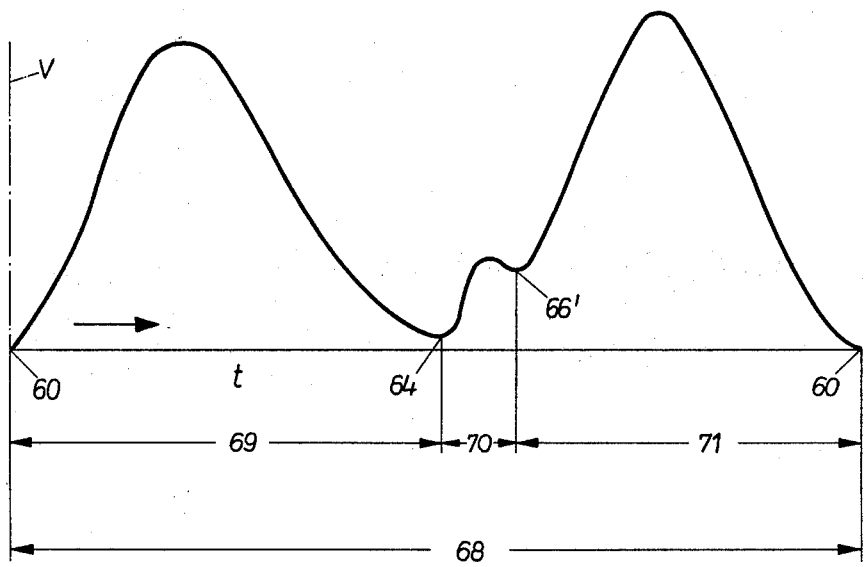
FIG. 7 is a velocity-time diagram of the sheet feeding apparatus shown in FIGS. 1 to 5.

The velocity-time diagram of FIG. 7 illustrates the track velocity of the traveling feed grippers 3 as a function of time. The course 68 represents the time for one revolution of the machine i.e. for 360° rotation. The course 69 corresponds to the time required for the feed grippers 3 to receive and transfer a sheet from the sheet transfer position 60 to the sheet deposition 64, and amounts to about 183° of one machine revolution. The course 70 denotes the lowering motion extending approximately over 30° of a machine revolution. The course 71 represents the time of return of the feed grippers 33, amounting to about 147° of a machine revolution. the traveling feed grippers 3 therefore start in the sheet transfer position 60 at a velocity of zero. Contrary to the aforementioned and previously known construction, the velocity, however, increases quickly only after an initial slow acceleration and is reduced prior to reaching the sheet deposition 64, where the feed grippers 3 release their grip at an initially rapid deceleration rate, gradually reaching almost a velocity of zero. The return movement of the traveling feed grippers 3 is broken down into a depressive motion time and a return motion tiem, the curve segment from the point 64 to the point 66' indicating the depressive movement of the feed grippers 3 below the feed table 10. The velocity curve then increases, finally decelerating at first quickly, and then gradually, prior to reaching the sheet transfer position 60.

The curve of the velocity-time diagram shows clearly the difference between the change of velocity of a drive according to the invention compared to a conventional crank drive. The velocity-time diagram of a conventional crank drive shows a considerable acceleration prior to and following the respective sheet transfer and sheet deposition points 60 and 64; it is therefore evident that the approximate stand-still position of conventional feed grippers is achieved from a high velocity without any significant deceleration phase.

In the drive according to the invention, however, the curve segments just prior to and just following the respective reversal positions 60 and 64 show a relative small acceleration resulting in a particularly good deceleration just prior to the respective sheet transfer and sheet depositions. This also results in a prolongation of the approximate stand-still phase of the feed grippers at their respective reversal points, therefore ensuring an extremely exact sheet transfer by the suction bars 1 as well as a soft or light sheet deposition upon the front stops 15 as compared to that for a conventional crank drive, in spite of a higher mean feed-gripper velocity.

I claim:

1. In sheet feeding apparatus of the type having a feed table, feed grippers movable back and forth to transfer sheets on the feed table, carrier means including an oscillating lever, a shaft, a crankwheel mounted on the shaft and a coupler connected between the crankwheel and the lever, the carrier means being movable above the feed table between a first and a second position for mounting the feed grippers thereon, drive means and operable means for respectively moving and lowering the carrier means so as to dispose the feed grippers below the top surface of the feed table as the carrier means commences a return movement to the first position, the improvement comprising an eccentric crankpin mounted on the crankwheel and connected to the coupler at a location thereof spaced from the location at which the coupler is connected to the oscillating lever; and motion generating means including the crankwheel actuated by the driving means for imparting a cycloid motion to said eccentric crankpin about the center of rotation of the crankwheel, said motion generating means also comprising a bearing sleeve having a rim coaxially secured to the shaft; a sun gear connected to said rim; and a planetary pinion secured coaxially to said eccentric crankpin mounted on the crank-wheel.

2. Sheet feeding apparatus according to claim 1 comprising a lateral wall, said sun gear facing said lateral wall forward of the crankwheel.

3. Sheet feeding apparatus according to claim 2 wherein the oscillating lever is mounted on a fulcrum bearing and is oscillatable about a rotary axis at said fulcrum bearing, a bearing sleeve secured to said lateral wall, an eccentric shaft rotatably supported in said bearing sleeve and having an offset end on which said fulcrum housing is mounted; crank lever drive means connected to the other end of said eccentric shaft for turning said eccentric shaft back and forth through a given angle in synchronism with the operation of the apparatus.

4. A method of manipulating a sheet by feed grippers actuated by a driving mechanism in a sheet feeding apparatus of the type having a feed table, feed grippers movable back and forth to transfer sheets on the feed table, carrier means including an oscillating lever, a shaft, a crankwheel mounted on the shaft and a coupler connected between the crankwheel and the lever, the carrier means being movable above the feed table between a first and a second position for mounting the feed grippers thereon, drive means and operable means for respectively moving and lowering the carrier means so as to dispose the feed grippers below the top surface of the feed table as the carrier means commences a return movement to the first position, which comprises the sequential steps of gripping a sheet by the feed grippers at a sheet transfer position; moving the sheet over the feed table at an initially relatively low acceleration followed sequentially by a relatively high acceleration to a maximum velocity, a relatively high deceleration and a final gradual relatively low deceleration to a velocity slightly above zero prior to setting down the sheet in a sheet deposition position; opening the feed grippers to release the sheet; and returning the feed grippers at least partly along a path located below the feed table at a relatively high acceleration to a maximum velocity followed by a relatively high deceleration and terminating in a gradual relatively low deceleration to a velocity of zero so as to restore the feed grippers to the sheet transfer position.

5. In a sheet feeding apparatus of the type having a feed table, means for gripping a sheet by the feed grippers at a sheet transfer position; means for moving the sheet over the feed table at an initially relatively low acceleration followed sequentially by a relatively high acceleration to a maximum velocity, a relatively high deceleration and a final gradual relatively low deceleration to a velocity slightly above zero prior to setting down the sheet in a sheet deposition position; means for opening the sheet-gripping means to release the sheet; and means for returning the feed grippers at least partly along a path located below the feed table at a relatively high acceleration to a maximum velocity followed by a relatively high deceleration and terminating in a gradual relatively low deceleration to a velocity of zero so as to restore the sheet-gripping means to the transfer position.

* * * * *